United States Patent [19]

Neumann

[11] 4,175,313

[45] Nov. 27, 1979

[54] METHOD AND APPARATUS FOR MANUFACTURING DOOR FRAMES

[76] Inventor: Paul G. Neumann, 1324 Hickory La., Orange, Calif. 92666

[21] Appl. No.: 898,108

[22] Filed: Apr. 20, 1978

[51] Int. Cl.[2] ..... B27F 7/02

[52] U.S. Cl. ..... 29/430; 29/432; 29/771; 144/309 N

[58] Field of Search ..... 29/430, 432, 771, 772, 29/822; 227/45; 144/309 N; 269/321 F; 100/DIG. 13; 49/382

[56] References Cited

U.S. PATENT DOCUMENTS

| | | | |
|---|---|---|---|
| 937,430 | 10/1909 | Evans, Jr. | 144/309 N |
| 2,574,163 | 11/1951 | Bamford, Sr. | 144/309 N |
| 3,106,136 | 10/1963 | Langas et al. | 91/417 |
| 3,443,303 | 5/1969 | Groat | 29/432 |
| 3,564,702 | 2/1971 | Hurn et al. | 29/430 |
| 3,574,920 | 4/1971 | Stirling et al. | 29/430 |
| 3,628,714 | 12/1971 | Offenwanger | 227/7 |
| 3,681,842 | 8/1972 | Blakeslee | 29/430 |
| 3,763,547 | 10/1973 | Blakeslee | 29/430 |
| 3,822,815 | 7/1974 | Davis | 227/7 |
| 4,039,112 | 8/1977 | Schultz | 227/40 |

*Primary Examiner*—Lowell A. Larson
*Attorney, Agent, or Firm*—Gausewitz, Carr & Rothenberg

[57] ABSTRACT

A method and apparatus for making rectangular frames, e.g., for doors, are described. Stiles and headers are spaced apart on conveyors, automatically closed into rectangles, and fastened at the corners without clamping them together. Fastening means, e.g., staple guns, are suspended to pivot through arcs above the frame and inject fasteners when they are in the bottom dead center position in the arcs. Stiles with lockblocks attached can be rotated to position the lockblocks inside the rectangle.

5 Claims, 16 Drawing Figures

FIG. 1.
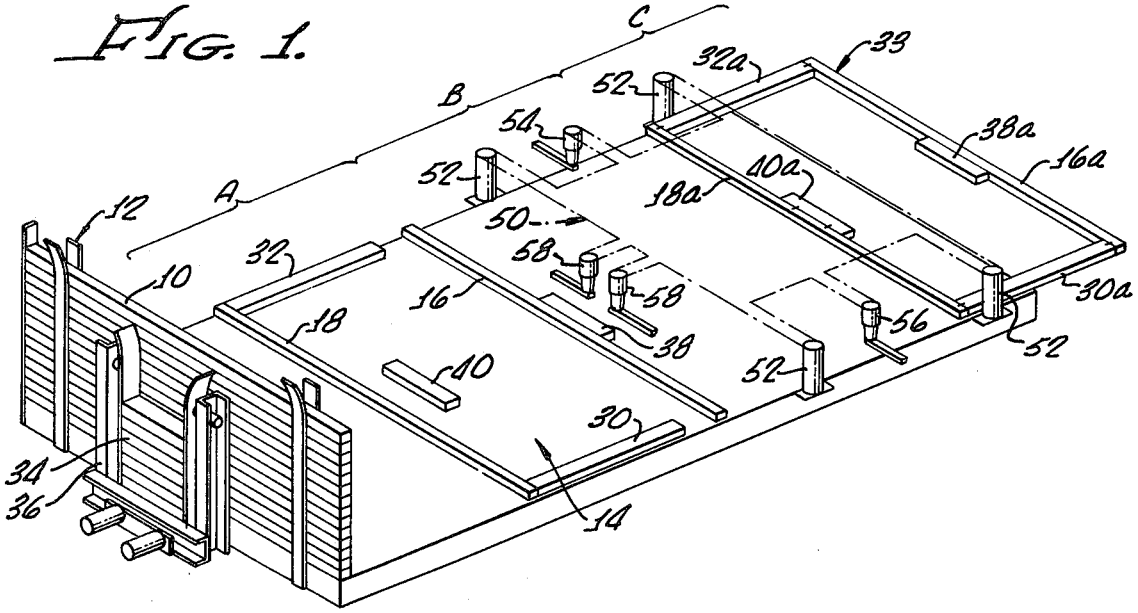
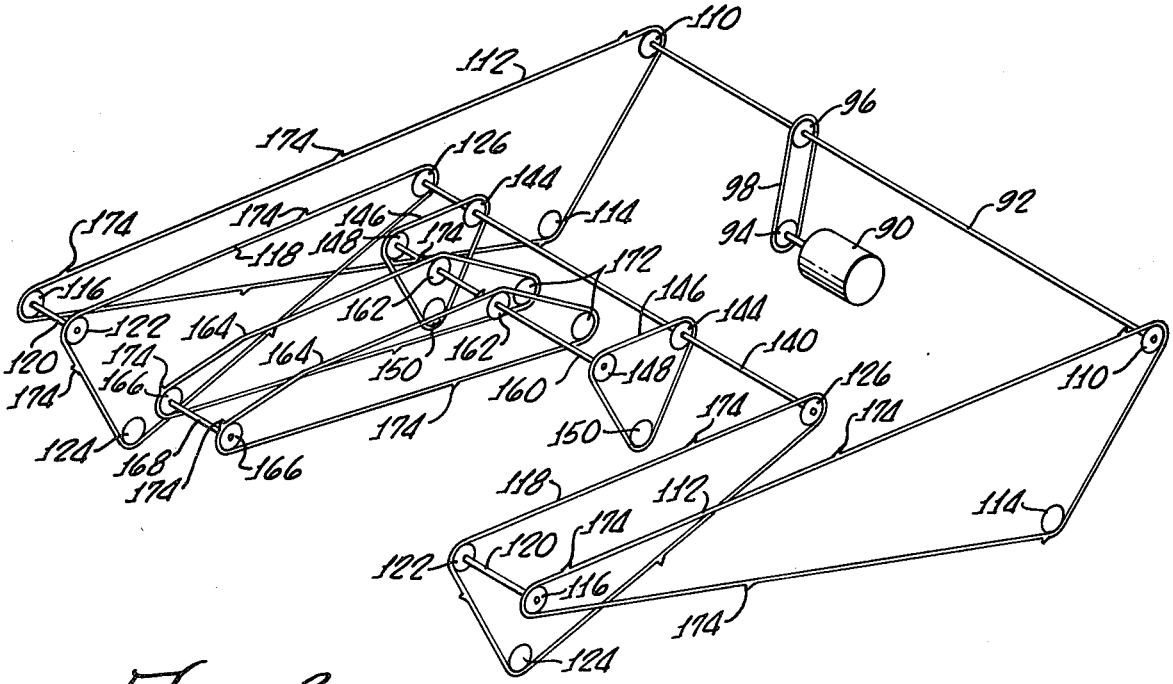
FIG. 3.

FIG. 4.
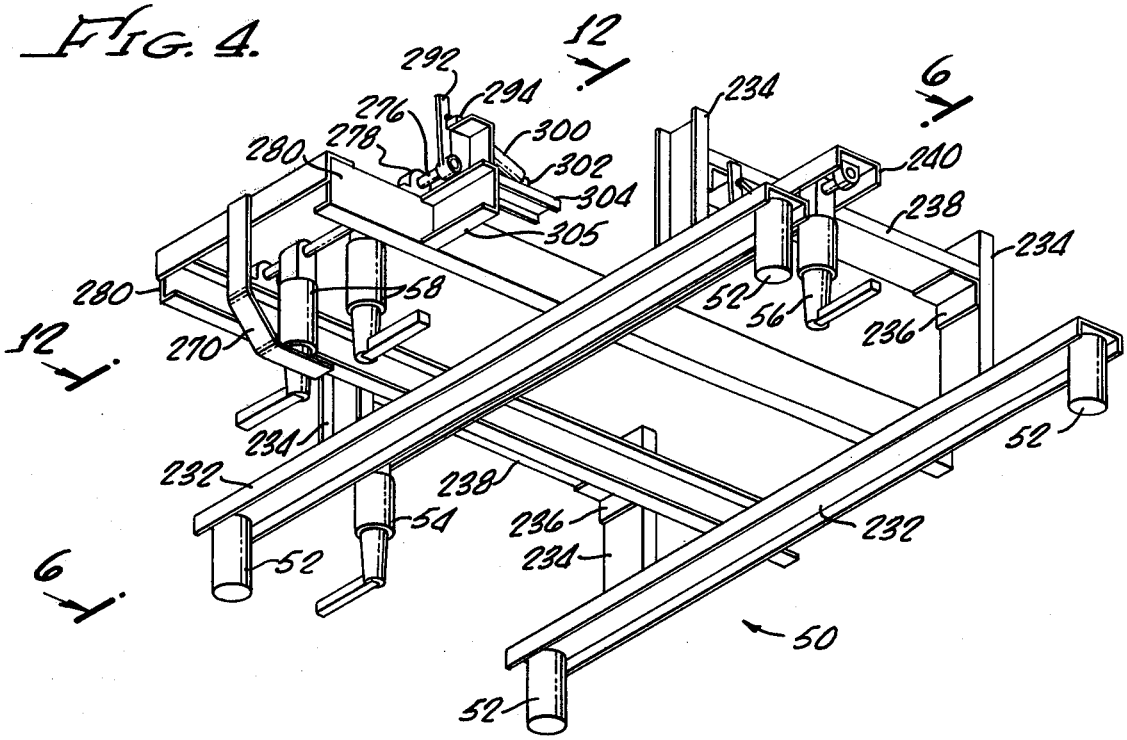
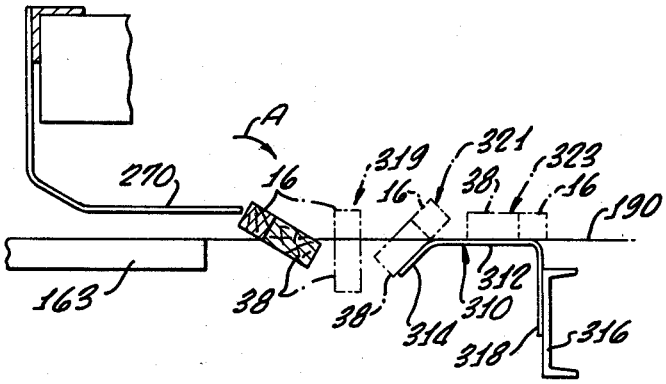
FIG. 10.
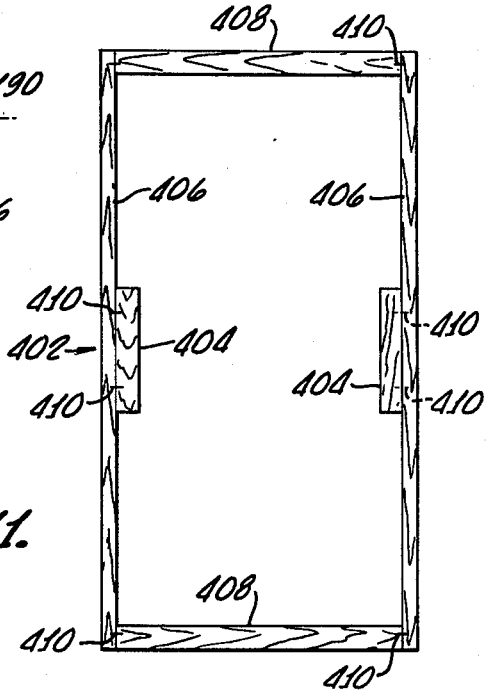
FIG. 11.

METHOD AND APPARATUS FOR MANUFACTURING DOOR FRAMES

BACKGROUND OF THE INVENTION

This invention relates to methods and apparatus for manufacturing rectangular frames for doors.

The manufacture of doors for houses, office buildings, and other structures has long been handicapped by the need for virtually total manual assembly of the door frames. In a typical door manufacturing process, rectangular frames of standard sizes are manually assembled from wooden vertical members or stiles and wooden horizontal members or headers. A core, usually of lightweight filler material, is inserted within the rectangular frame, and then inner and outer surfacing materials such as plywood are laminated over both sides of the frame and filler. Thereafter, a door knob, lock, and other desired attachments may be installed to complete the door.

Automation of the assembly of many prefabricated building components such as walls, floors, ceilings, and the like, has been attempted for many years. It has been possible to partially automate the manufacturing steps for some prefabricated building components, albeit with varying degrees of success. Even in the manufacture of doors some automation has been achieved in the steps of installing filler materials and surface laminates to door frames. However, the assembly of the door frame itself has heretofore defied all attempts to employ a continuous, automated manufacturing process. Not only has much expensive manual labor been required in making frames, but also non-uniform structures with improperly aligned stiles, headers, fasteners, or all of these, are sometimes produced due to human error, fatigue, and the like. The manual production of door frames also creates a serious bottleneck in what otherwise might be a relatively speedy door-making process.

Even when attempts are made to speed up the manual construction of door frames, for example, by using preset jigs for aligning the boards which make up the stiles and the headers of the frame, such attempts are only partially successful. This is due to the fact that for each given arrangement of apparatus, generally only one type of frame can be produced. Preferably, door frame-making apparatus should be capable of being adapted to use boards, i.e., stiles and headers, of various lengths, widths, and thicknesses without any appreciable time delay. It is especially desirable that door frame-making apparatus be capable of automatically adjusting itself to make any width of door without any operational changes by the operators, except, of course, to use different sizes of headers in the frame.

It is also desirable to have a fully continuous feeding operation to initiate the construction of each door frame without the necessity for manually starting the sequence. In other words, the human element should be simply to respond to the needs of the automated machine rather than to initiate each sequence, since any requirement for human intervention to start each sequence will necessarily result in time delays, depending on the self-discipline of the operator and other human variables.

Still another problem with prior art techniques is the need for special manual steps for fastening one or more lockblocks to the frame. When a doorknob, or a lock, or both, are to be installed, the frame stile itself generally is not wide enough to support such devices. To allow for the knob and lock to be installed thus requires that a short wide board or lockblock be secured inside the frame adjacent to the stile at the height where the knob and lock are to be positioned. This has heretofore required distinct manual installation and fastening steps which have added to the time consumption and potential for human error in placement or fastening of the lockblock to the stile. Moreover, since many doors are initially constructed without any knob or lock, and the decision is left to the user which side to install such devices on, it is often necessary to include lockblocks along both stiles. In the prior art techniques, this required still more manual steps with their attendant disadvantages.

Another problem with the prior art techniques for manufacturing door frames is in the variable placement of the fasteners, usually staples, which hold members of the frame together. if the staples are positioned too close to the top of the upper header, too close to the bottom of the bottom header, or too close to the outer edges of either of the stiles, this can cause problems after the door is fully assembled and the fasteners are covered up. For example, if it becomes necessary for the user to trim the ends or sides of the door by sanding it or sawing off an edge in order to install it, the sanding or sawing operation may be frustrated by encountering the misplaced staples. Thus, it would be highly desirable to provide the art with a method whereby human error in installing fasteners could be eliminated and the fasteners could be uniformly and consistently inserted in the frame at a precise distance as close to the inner edges of the stiles and headers as possible.

It is also desirable to provide a machine suitable for high speed door frame production while allowing for a variation in speed of human participation depending upon the size and weight of materials being manually handled and the state of fatigue of the operators. Thus, it would be desirable to provide a high speed process where all the steps of the operation are coordinated with each other yet permit speeding or slowing of the whole operation depending on the capacity of the operators to respond to the machine steps.

To achieve the foregoing and other goals, and to eliminate or lessen the problems of the prior art, are the objectives of this invention.

SUMMARY OF THE INVENTION

This invention contemplates a continuous rapid process for assembling wooden constituents, i.e., stiles and headers, into finished rectangular door frames. The stiles are fed to conveyor means at predetermined spaced intervals from a stile hopper, conveyed to an assembly platform, and then conveyed thereon parallel to each other. The forward stile is fed and conveyed along to a distance greater than the length of the headers to be used for the particular frame before the rear stile is fed to the conveyor means.

The top and bottom headers are then inserted between the ends of the forward and rear stiles and maintained perpendicular thereto by guide means provided on the assembly platform. The rear stile is then conveyed forward, contacting the rear ends of the top and bottom headers and pushing them forward until the forward ends of the headers contact the respective ends of the forward stile, to thus form the stiles and headers into a closed rectangle.

The conveying means continues to push the rear stile forward, thus moving the rectangular frame components along the assembly platform. As the frame components pass predetermined points, fastening means are automatically driven into each corner to fasten the headers and stiles together, thus forming a finished frame.

The invention also contemplates, in its preferred embodiments, means for fastening lockblocks to the forward stile, the rear stile, or both of them. The apparatus may include means for continuously feeding lockblocks to positions ahead of one or both stiles on the assembly platform, automatically closing the space between lockblocks and their associated stiles, and then fastening them together. When a lockblock is fastened to a forward stile, the invention also may include means for automatically rotating the stile about its own axis after fastening the lockblock to it, to position the lockblock to the rear of the forward stile, i.e., inside the rectangle formed by the stiles and headers, before fastening the forward stile to the headers.

It is also contemplated to provide coordinating means for automatically setting the guide means for the stiles and the headers and the fastening means to accomodate stiles, headers and lockblocks of different lengths, widths and thicknesses in order to make a variety of types and sizes of door frames.

BRIEF DESCRIPTION OF THE DRAWINGS

FIG. 1 depicts schematically a frame-making machine, with details omitted, illustrating the major functional components;

FIG. 3 is a schematic drawing showing the conveying means exploded laterally to show the conveyor chains and sprockets;

FIG. 4 shows, in perspective, an overhead staple gun carriage assembly looking from beneath the assembly;

FIG. 10 is a cross-sectional schematic taken along line 10—10 of FIG. 2, illustrating means for rotating the forward stile and lockblock;

FIG. 11 shows a finished, stapled door frame with lockblocks fastened to both forward and rear stiles;

DETAILED DESCRIPTION OF THE INVENTION

Figure 2:
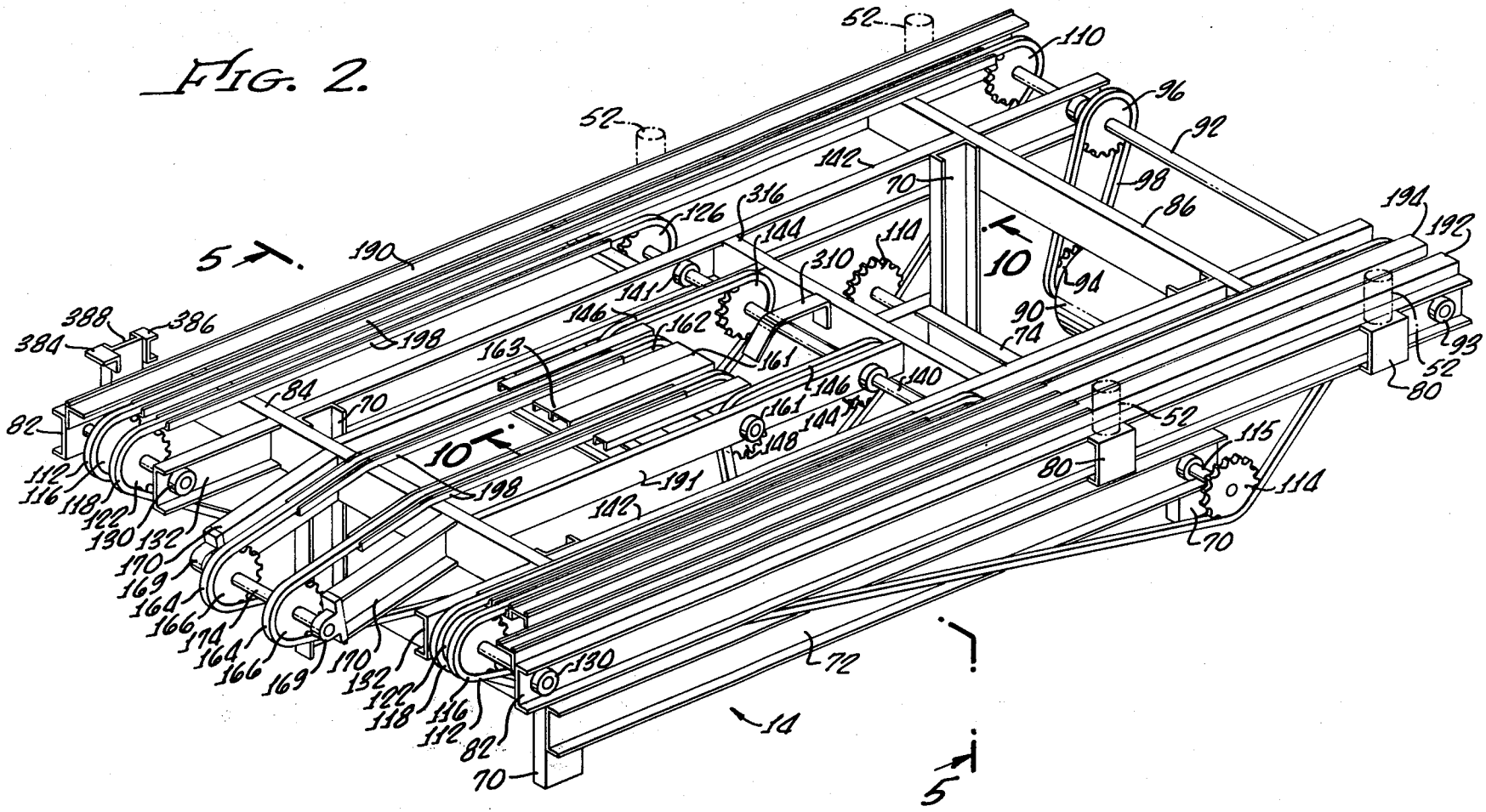
FIG. 2 shows the structural components of the assembly platform and conveying means with details omitted for clarity.

FIG. 1 shows schematically the major structural and functional components of a door frame-making machine constructed in accordance with the invention. The overall operation of a particular embodiment may be described briefly with reference to FIG. 1.

Vertical frame members or stiles 10 are stored in a stile hopper 12 and fed at predetermined intervals to a conveying means (not shown in FIG. 1) by which they are conveyed along assembly platform 14 in pairs which form the forward stile 16 and rear stile 18 of a door frame to be constructed. FIG. 1 shows such a pair of stiles 16 and 18 before assembly in Zone A on the left side of the drawing and shows the same stiles with reference numerals **16*a* and 18*a*** after being fastened into a rectangular frame in Zone C on the right side of the drawing.

A lower cross piece or header 30 and an upper cross piece or header 32 is inserted between the forward and rear stiles 16 and 18. (Headers 30 and 32 are shown before being fastened into the rectangular frame in Zone A of FIG. 1 and are shown as headers **30*a* and 32*a* in Zone C after being fastened.) It is preferred generally that the headers 30 and 32 be manually positioned on assembly platform 14**, since this gives the operators an opportunity to examine the headers for defects and enables them to rotate both the stiles and headers to keep any defects in the least disadvantageous positions.

When lockblocks are desired to be installed in the door frames, a supply of lockblocks 34 is stored in lockblock hopper 36, from which individual forward and rear lockblocks 38 and 40 are conveyed at predetermined intervals along assembly platform 14. Forward and rear lockblocks 38 and 40 are shown in Zone A before fastening to the door frame and are shown as lockblocks **38*a* and 40*a*** in Zone C after fastening.

Zone A, shown at the left side of FIG. 1, depicts all of the stiles, headers, and lockblocks laid out on the assembly platform prior to being closed up into rectangular form and fastened together. Zone B shows the stapling zone of the apparatus, where the various components are moved together and fastened securely to each other. It is to be noted that the forward stile 16 and forward lockblock 38, as shown in Zone A, are in reverse position relative to one another compared to the positions of stile **16*a* and lockblock 38*a* in the finished frame, as shown in Zone C. Thus, it is an aspect of this embodiment of the invention to rotate the forward lockblock 38 and the forward stile 16 after they are stapled together, so that the lockblock is inside the finished rectangular frame 33**. The means for rotating these components will be described in detail hereinafter.

Included in Zone B of FIG. 1 are the overhead staple gun carriage assembly 50, (shown mostly in ghost outline), which includes a pneumatic support elevator 52 at each corner, an upper staple gun 54 for stapling the upper header 32 to forward and rear stiles 16 and 18, lower staple gun 56 for stapling lower header 30 to forward and rear stiles, and lockblock staple guns 58 for stapling the lockblocks 38 and 40 to the forward and rear stiles, respectively.

The pneumatic support elevators 52 operate simultaneously to position the staple gun carriage assembly such that the various staple guns are at a proper height above the wooden components to be stapled, depending upon the thickness of wood used to make the frame. The details of the operation of the staple gun carriage assembly and the staple guns therein will be discussed in detail hereinafter.

FIG. 2 shows the assembly platform 14 in more detail. The overhead staple gun carriage assembly 50 of FIG. 1 is not shown in FIG. 2; however, the four pneumatic support elevators 52 are shown in ghost outline to illustrate the location of the gun carriage assembly 50 relative to the assembly platform 14.

The structural elements of assembly platform 14 include the four leg members 70, which are braced longitudinally by longitudinal braces 72 and transversely by two end transverse braces 74.

The upper portion of assembly platform 14 includes the various components which make up the conveyor system and the working surfaces for frame assembly. The pneumatic support elevators 52 are mounted on elevator mounts 80 which are welded or bolted to elevator support beams 82, the latter running longitudinally along either side of the assembly platform 14. Elevator support beams 82 are supported by front cross beam 86 and rear cross beam 84 at the ends of the assembly platform 14.

The conveyor means for assembling and moving frame components along the frame-making apparatus can best be understood by reference to FIGS. 2 and 3. FIG. 2 shows the structural support for the conveyor chains, and FIG. 3 shows schematically the relationship of the various conveyor chain sprockets and axles. An adjustable speed drive motor 90 provides power to main drive shaft 92 through sprockets 94 and 96 and drive chain 98. Main drive shaft 92 is supported on bearing means 93 mounted on elevator support beams 82. Front stile drive chain sprockets 110 are mounted near each end of main drive shaft 92 and drive the rear stile drive chains 112 about idler sprockets 114 and rear sprockets 116. The idler sprockets 114 are mounted on an axle 115 and can be positioned to tighten or loosen drive chain 112, as desired.

Rear sprockets 116 also drive the foward stile drive chains 118 through drive shafts 120, sprockets 122, 124 and 126. Drive shafts 120 are mounted in bearing means 130 which are mounted on elevator support beams 82 and bearing support struts 132 at either side of assembly platform 14. The bearing support struts 132 are attached to rear cross beam 84.

Sprockets 126 drive axle 140 which is mounted in bearing means such as bearing 141 affixed to longitudinal bearing support beams 142. Beams 142, in turn, are welded or bolted to legs 70 and to front and rear cross beams 86 and 84.

Axle 140 also serves as a drive shaft to drive sprockets 144 which, in turn, drive stile support chains 146 and sprockets 148. Idler sprockets 150 are also employed with stile support chains 146 and are adjustable (by means not shown) to tighten or loosen the support chains, as desired.

Sprockets 148 also serve to drive axle 160, which is mounted in bearing means 161 affixed to the longitudinal bearing support beams 191. Axle 160, in turn, acts as a drive shaft for sprockets 162 which drive a pair of lockblock drive chains 164. Also associated with the lockblock chains 164, are sprockets 166 which are mounted on axle 168 which, in turn, is mounted in bearing means 169 affixed to lockblock bearing struts 170. Idler sprockets 172 are used to tighten or loosen lockblock drive chains 164, as desired.

FEEDING AND LAYOUT SEQUENCE

It may be seen from the foregoing that all of the various drive chains 112, 118, 164 and 146 are interconnected, and are provided in pairs positioned on each side of the assembly platform, such that the speed of all of them can be controlled by adjusting the speed of motor 90. Also, all of the various corresponding sprockets are sized such that the linear speeds of all of the drive chains are identical. As shown in FIG. 3, all of the chains except stile support chains 146 are equipped with numerous lugs 174 which grip or engage the stiles and lockblocks to convey them along the assembly platform 14. Accordingly, the various lugs 174 must be positioned on the drive chains to properly sequence the feeding and conveying of the various door frame components as hereinafter described.

The sequence of feeding and layout of the various components in accordance with a preferred embodiment of the invention will now be described with reference to FIGS. 1, 2 and 3.

To initiate the feeding and layout sequence, a stack of stiles 10 and lockblocks 34 are stacked in their respective hoppers 12 and 36. The bottom of the stack of stiles 10 rests at each end on the pairs of rear stile drive chains 112 and forward stile drive chains 118. Similarly, the stack of lockblocks 34 rests upon the pair of lockblock drive chains 164.

When the motor 90 is started, all the various chains begin to move in a clockwise direction as viewed in FIGS. 2 and 3. When the lugs 174 on lockblock drive chains 164 engage the bottom lockblock in lockblock hopper 36, they pull the lockblock along assembly platform 14. (The remaining lockblocks 34 in lockblock hopper 36 then drop down by gravity feed into position to be engaged by the next set of lugs 174 on lockblock drive chains 164.)

The lockblock 38 which was picked up by the lugs on lockblock drive chains 164 is conveyed beneath the stile hopper 12 and positioned on the horizontal portion of assembly platform 14. To provide clearance for the lockblock to pass beneath stile hopper 12, it is necessary that lockblock bearing struts 170 be canted downwardly from assembly platform 14 as shown in FIG. 2 to provide a clearance between the stile hopper and the lockblock drive chains 164 greater than the thickness of a lockblock. After lockblock 38 passes beneath hopper 12, a set of lugs 174 on the forward stile drive chains 118 engage stile 16 and convey it from the hopper 12 along assembly platform 14 behind lockblock 38 as shown in FIG. 1.

At a predetermined distance behind forward stile 16, a second lockblock 40 is similarly fed from lockblock hopper 36, and a rear stile 18 is fed from stile hopper 12 and conveyed along assembly platform 14 by the rear stile drive chains 112.

Operators standing along either side of the assembly platform preferably manually install lower and upper headers 30 and 32, positioning them longitudinally between stiles 16 and 18 as shown in FIG. 1. The header 32 is positioned on upper header guide rail 190, best shown in FIG. 2. Lower header 30 is similarly positioned on lower header guide rail 192 or movable header guide rail 194, depending upon the length of door frame desired.

Figure 5:
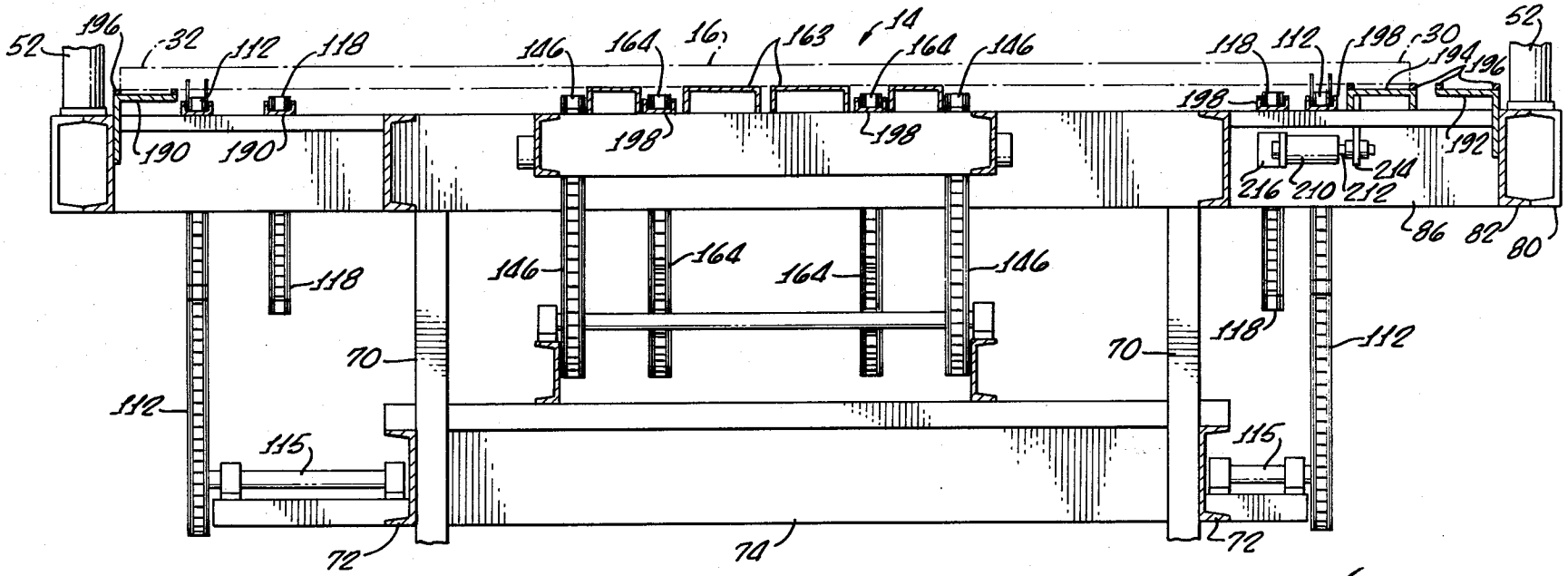
FIG. 5 is a cross-sectional view of an assembly platform taken along lines 5—5 of FIG. 2.

FIG. 5 shows the relationship of the stiles, headers, and assembly platform 14 in cross section looking along line 5—5 of FIG. 2. As shown in FIG. 5, forward stile 16 is positioned transversely across assembly platform 14, resting upon forward stile drive chains 118, rear stile drive chains 112, lockblock drive chains 164 and stile support chains 146. The ends of stile 16 also rest on upper header guide rail 190 and movable header guide rail 194, (forward of the two headers 32 and 30, respectively). It should be noted that each of the guide rails is equipped with a pair of lips 196 which insure that the headers remain on the assembly platform 14 positioned perpendicular to the pair of stiles 16 and 18. (The lips terminate before the components reach the stapling guns, to permit both the headers and the stiles to rest on the same horizontal plane defined by the upper surfaces of the guide rails at the time they are stapled together.)

Also shown in FIG. 5 are the chain support channels 198 in which the forward and rear stile drive chains and lockblock drive chains are horizontally supported between the various sprockets along the upper surface of assembly platform 14, as previously described with reference to FIG. 2. These channels keep the various chains from bouncing and provide a uniform horizontal support which, in turn, insures that the various stiles and lockblocks are maintained in the same horizontal plane.

In the embodiment shown in FIG. 5, the apparatus can be used to assemble door frames of three different lengths. Thus, if the upper and lower headers are installed on upper header guide rail 190 and lower header guide rail 192, a door frame 7 feet long is produced. On the other hand, if the header is installed on movable header guide rail 194, as shown in FIG. 5, door frames of either 6'7" or 6'8" can be produced. The apparatus is thus adaptable to instant adjustment to make all three of the common sizes of door frames. The operator simply activates pneumatic cylinder 210 causing its piston 212 to move inwardly or outwardly. The movement of piston 212 produces a corresponding movement of movable header guide rail 194 through connecting means 214 which is bolted between piston 212 and the movable header guide rail 194.

Preferably, pneumatic cylinder 210 is mounted by mounting means 216 on cross member 86 as shown in FIG. 5. Another pneumatic cylinder (not shown) is preferably installed near the opposite end of movable header guide rail 194 to insure that the entire rail moves uniformly and simultaneously inwardly and outwardly.

It should be noted that it is possible to use the same length of stiles, regardless of the length of the door frame desired. Thus, for example, the 7 foot stiles can be used to produce a door frame only 6'7" in length by simply installing lower header 30 on the movable header guide rail (after positioning the rail in the 6'7" position) and then cutting off any extending portions of the stiles after the door frame is fully assembled.

THE ASSEMBLING AND FASTENING PROCESS

After the stiles and headers are in position as shown in Zone A on FIG. 1, these components must be brought into contact with each other to form a closed rectangle before they can be stapled together. Also, the forward lockblock 38 must be repositioned relative to forward stile 16 so that lockblock 38 is inside the rectanle formed by the stiles and headers, as described hereinafter. The components are then stapled together in Zone B.

In Zone B (See FIG. 1), the overhead staple gun carriage assembly 50 is positioned above the assembly platform 14 on four pneumatic support elevators 52. The underside of the overhead staple gun carriage assembly can be seen in perspective in FIG. 4. Therein the four pneumatic support elevators 52 are shown supporting assembly 50. The elevators have movable pistons (not shown) which raise and lower the main cross beams 232. Vertical posts 234 are mounted on the two main cross beams 232 and are attached by brackets 236, or by welding or other means, to longitudinal beams 238, which are positioned to run horizontally parallel to the assembly platform 14. The longitudinal beams 238 are connected as by bolting or welding to transverse staple gun axle support beam 240, on which is mounted staple gun upper axle 242 and lower axle 243 shown in FIG. 6. The axles are supported by conventional bearing means 252 and 253.

The staple gun axles 242 and 243 rotatably support upper staple gun 54 and lower staple gun 56, respectively.

The manner in which the closing up, repositioning, and stapling of the various components of the door frame is carried out will now be described with particular reference to FIGS. 1, 2 and 3.

When lockblock 38 is carried along assembly platform 14 by lockblock drive chains 164, it is apparent that the forward motion of the lockblock 38 will terminate just after the block passes axle 160. Thereafter, the lockblock will rest on the protruding end portion 161 of lockblock support beam 163 until the lockblock is overtaken by forward stile 16 being conveyed along by forward stile drive chain 118. When forward stile 16 catches up with forward lockblock 38 resting on the end portion 161 of lockblock support beam 163, it carries the lockblock along with it. The lockblock is held securely down against its support beam 163 by pressure foot 270 (shown on the left side of FIG. 4) extending down from elements of the overhead gun carriage assembly 50. The pressure foot 270 exerts a spring force on the lockblock which, through frictional resistance, insures that forward stile 16 is maintained in firm contact with forward lockblock 38 until they are stapled together.

Figure 12:
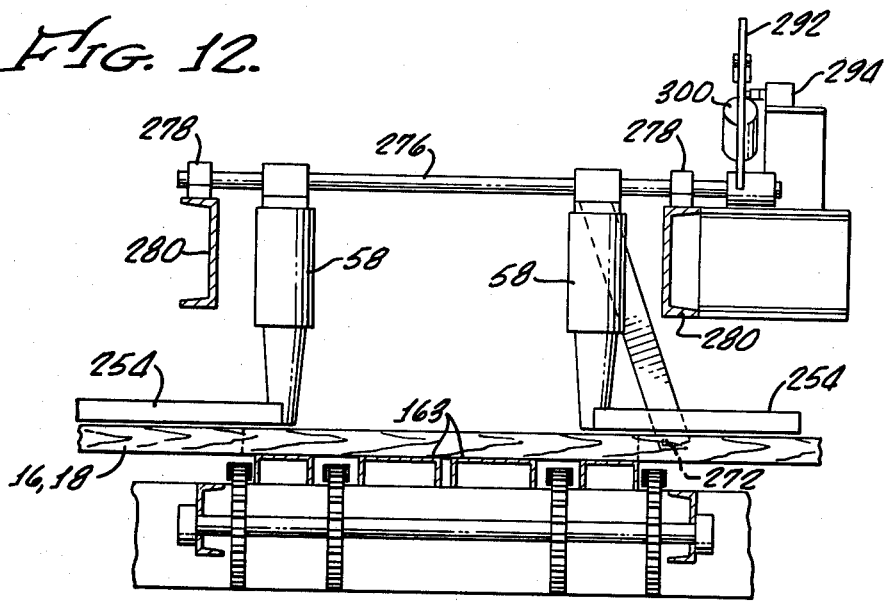
FIG. 12 is a cross-sectional view along line 12—12 of FIG. 4.
Figure 13:
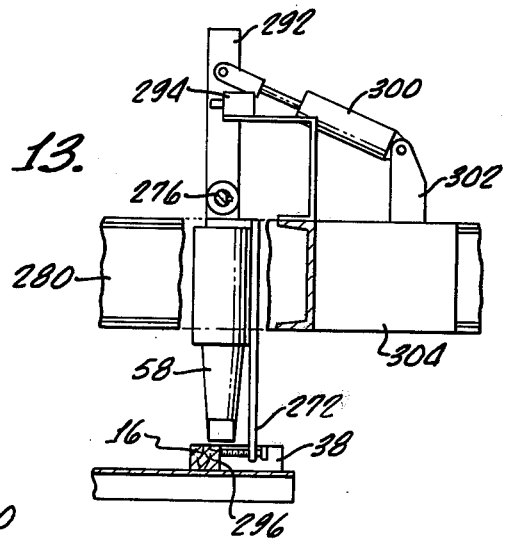
FIG. 13 is a side view from the right side of FIG. 12 depicting the stapling action of lockblock staplers.

As lockblock 38 continues to be conveyed forwardly along the assembly platform, it engages trigger means 272, which is best seen in FIGS. 12 and 13. Trigger means 272 is connected to the lockblock staple guns 58 and causes them to rotate, turning the lockblock staple gun axle 276 through bearing means 278, which are mounted on parallel lockblock staple gun support beams 280.

Initially, the staple guns are canted with their bottom ends slightly to the rear of bottom dead center. The lockblock forces the staple guns 58 into vertical positions as shown in FIG. 13. When the staple guns 58 are in the vertical position, each is triggered to fire a staple by the rotation of trigger arm 292, which activates valve 294 to transmit a compressed air supply to fire the staple guns (by means not shown). Thus, the staple guns always fire precisely at bottom dead center, i.e., when they are in exactly vertical positions. It should be noted that by setting trigger means 272 precisely, the axis of staple guns 58 will be vertical and will be precisely over the intersection 296 where the lockblock 38 contacts the forward stile 16, when the staple gun is fired.

After the staples are fired into lockblock 38 and forward stile 16, the continued forward motion of the stile 16 forces the staple guns 58 to rotate into a forward position, (not shown in FIG. 13), so that the lockblock and the stile can pass beneath it. Thereafter, the staple guns 58 are returned to their original positions by the action of lockblock staple gun return cylinder 300 which is mounted by mounting means 302 to beam 304, which in turn, is attached to support 305 of overhead assembly 50, best seen in FIG. 4.

After the forward lockblock 38 and forward stile 16 have been stapled together, it is necessary to rotate them about the axis of stile 16 in order to position the lockblock inside the door frame. This rotating operation can best be described with reference to FIGS. 2, 4 and 10. FIG. 10 shows a cross-sectional schematic view taken along Line 10—10 of FIG. 2. As shown therein, when lockblock 38 is forced off the end of support beam 163, it tends to fall both under its own weight. (Additionally, a spring loaded or weighted means can be mounted above the lockblock to press it downwardly, if desired.) Since lockblock 38 has been stapled to stile 16 at this point, it causes forward stile 16 to rotate clockwise as viewed in FIG. 10, as shown by the arrow A. Forward stile 16 is supported at each end by forward stile drive chain 118 and, thus, is free to rotate, with the chain links as pivot points. As driving chain 118 carries the stile and attached lockblock further forward, the lockblock 38 is engaged by scoop 310 causing it to rotate further, until the stile is conveyed forwardly still further and the two members are finally positioned in reverse position, as shown on the right side of FIG. 10. Scoop 310, as shown in FIGS. 2 and 10, comprises a horizontal section 312, connected to downwardly descending portion 314 and is fixed to horizontal beam 316 by flange portion 318, which may be welded or bolted into position. (The complete rotation of the stile and lockblock is shown in FIG. 10 in outlines 319, 321 and 323.)

After the forward stile 16 and attached lockblock 38 have been rotated and positioned on the horizontal portion 312 of the scoop 310, their forward motion temporarily stops, since the ends of stile 16 have, at that point, passed the sprockets 126 of forward stile driving chain 118. They rest in that position until headers 30 and 32, being conveyed forwardly by rear stile 18, come into contact with the ends of stile 16. After the headers have contacted the forward stile 16, they are stapled thereto.

Figure 6:
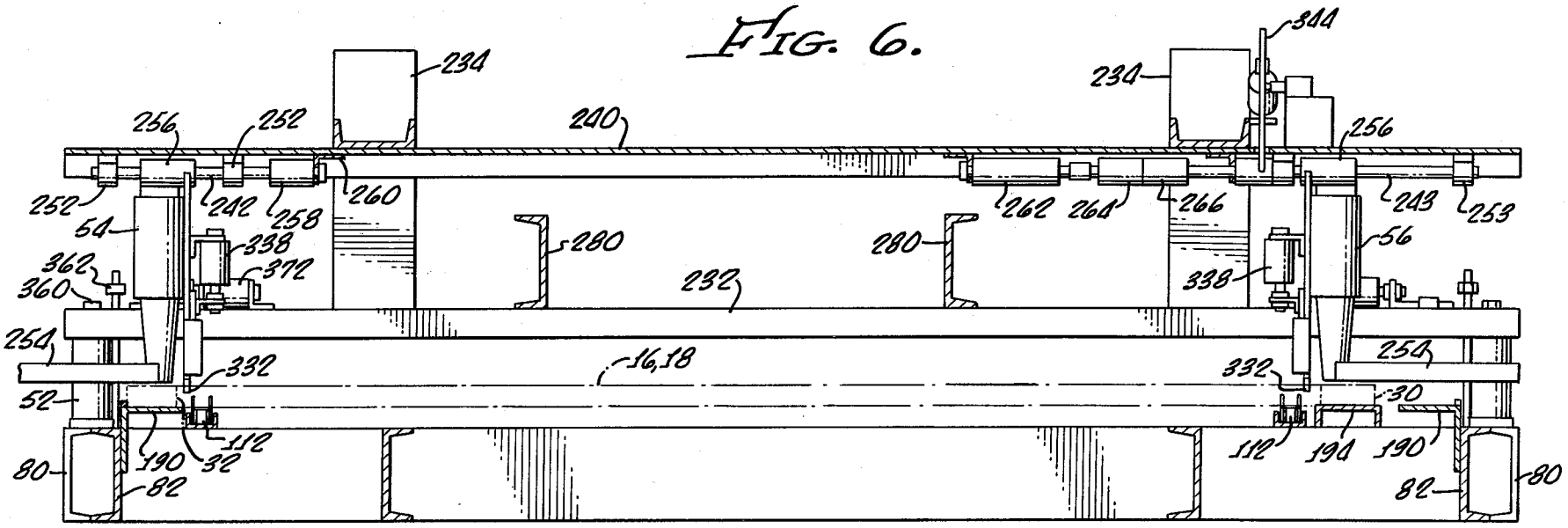
FIG. 6 is a cross-sectional view of an overhead staple gun carriage assembly taken along line 6—6 of FIG. 4, also illustrating the position of the staple guns relative to the assembly platform as shown in FIG. 5.
Figure 9:
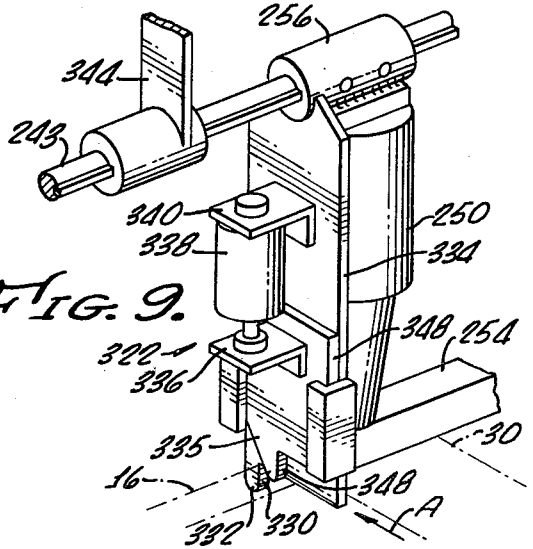
FIG. 9 is a perspective of a staple gun as it would appear looking from the back of FIGS. 7 and 8, showing the gun mounting arrangement and lower trigger assembly.
Figure 8:
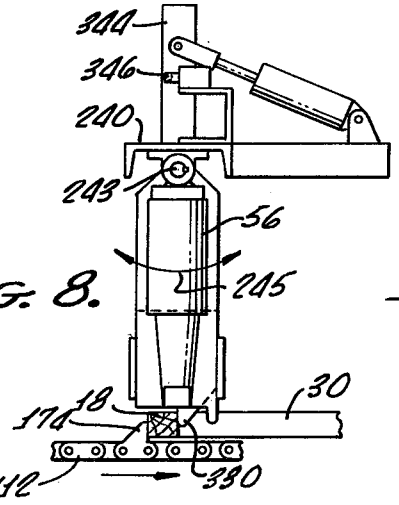
FIGS. 7 and 8 are side views looking from the right side of FIG. 6, with details omitted for clarity, depicting the action of a stapler gun fastening a header to forward and rear stiles, respectively.
Figure 7:
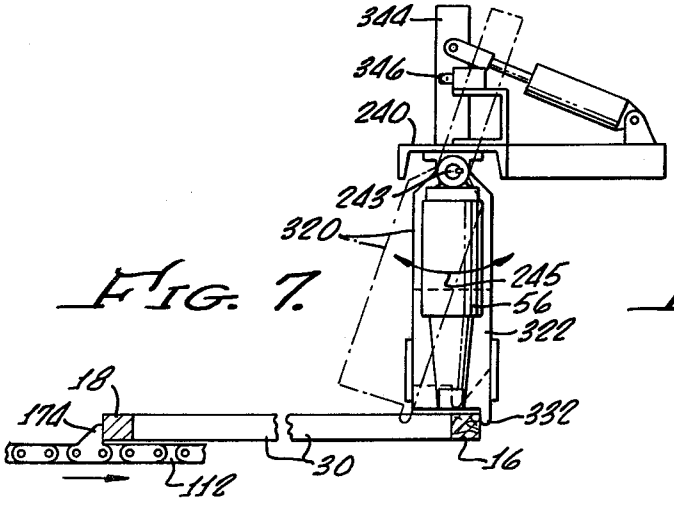

The operation of the staple guns and the staple gun carriage assembly 50 can be better understood by reference to FIG. 6, which is a cross-sectional view taken along line 6—6 of FIG. 4 and by reference to FIGS. 7, 8 and 9, which show various views of the right-hand or lower staple gun 56 of FIG. 6.

As shown in FIG. 6, axles 242 and 243 are mounted on axle support beam 240. Axle 242 is supported by bearing means 252 and axle 243 is supported by similar bearing means 253. Conventional staple guns 54 and 56 equipped with staple magazines 254 are secured to the axles 242 and 243 using mounting attachments 256.

FIG. 6 also shows a pneumatically-operated cylinder 258 mounted by mounting bracket 260 to the staple gun axle support beam 240. The pneumatically-operated cylinder 258 is adapted to move axle 242 axially to carry the gun 54 inwardly or outwardly for use with headers of different widths.

A similar arrangement of pneumatically-operated cylinders is provided to move axle 243 inwardly and outwardly to move lower staple gun 56 for stapling headers of different widths and also for making door frames of different heights. Thus, there is shown in FIG. 6, three pneumatically-operated cylinders 262, 264 and 266. Cylinder 262 is adapted to move gun 56 4" while cylinders 264 and 266 can each move the gun 1". Thus, it is possible to use one or more of the cylinders to obtain a variety of movements of the position of axle 243 and staple gun 56.

FIGS. 7 and 8 illustrate the action of staple gun 56 in stapling together stiles 16 and 18 and lower header 30. FIG. 7 shows a view looking from the right end of FIG. 6, omitting most of the details for clarity. FIG. 7 shows the staple gun 56 stapling the forward stile 16 to the lower header 30, and FIG. 8 shows a similar view in which the same stapler 56 is stapling header 30 to rear stile 18.

The operation of the staple guns 54 and 56 to staple the forward stile 16 to the header 30 is similar to that described previously for the operation of the lockblock staple guns 58. Thus, for example, as illustrated in FIG. 7, staple gun 56 is initially in slightly canted position as shown in ghost outline 320. The trigger means 322 is engaged by the forward edge of forward stile 16 and causes axle 243 to rotate until the staple gun swings through arc 245 in a plane parallel to the movement of the stiles and headers and reaches bottom dead center and fires, as previously described in connection with the operation of lockblock staple guns 58.

In a particularly advantageous aspect of this invention, it is contemplated to use the same staple gun 56 to fasten both the forward and rear stiles to a header. This requires that the staple gun fire a staple at different times according to the position of the components of the door frame. Accordingly, a different triggering means is required to trigger staple gun 56 to staple the forward stile to header 30 than that required to fire the gun to staple the rear stile to the header. The improved triggering means is shown in perspective in FIG. 9 as it would appear looking from the back of FIGS. 7 and 8.

Referring to FIG. 9, the direction of travel of the door frame components is as indicated by the arrow A. As the forward stile 16 is conveyed along the assembly platform (not shown in FIG. 9), the leading edge of stile 16 abuts the surface 330 of projection 332 extending downwardly as a part of trigger means 322. Projection 332 extends downwardly from flat rectangular plate 334, which is secured by attachment 256, which is keyed to axle 243 and, thus, converts the forward motion of stile 16 to a rotary motion of axle 243. The rotary motion moves arm 344 into contact with pneumatic switch 346, best shown in FIGS. 7 and 8, which causes the staple gun 56 to fire and fasten forward stile 16 to header 30.

After the forward stile is fastened to the header, the rear stile 18 continues to be conveyed forward by the rear stile drive chain. By comparing FIGS. 7 and 8, it will be readily seen that staple gun 56 must fire a staple near the trailing edge of forward stile 16, but near the leading edge of rear stile 18. Thus, if the same staple gun is to be used to fire both staples, it is necessary to employ a different triggering arrangement. This can be achieved as shown in FIG. 9, by lowering flat plate 335 by action of the pneumatic cylinder 338 (mounted on brackets 336 and 340 to plates 335 and 334) so that the leading edge of forward stile 16 first contacts surface 348 of flat plate 335 instead of surface 330. Thus, the leading edge of the trailing stile 18 will activate trigger means 322 prior to reaching the position reached by the forward stile 16 when it activated the triggering means 322. The precise difference in positions of the two stiles at the time they cause the staples to fire will depend upon the horizontal distance between surface 348 and surface 330, which distance is selected according to the thickness of stile used to make the door frames. While the triggering operation has been described with reference to gun 56, it will be appreciated that staple gun 54 on the opposite side of assembly 50 can be simultaneously fired by the same means.

Figure 16:
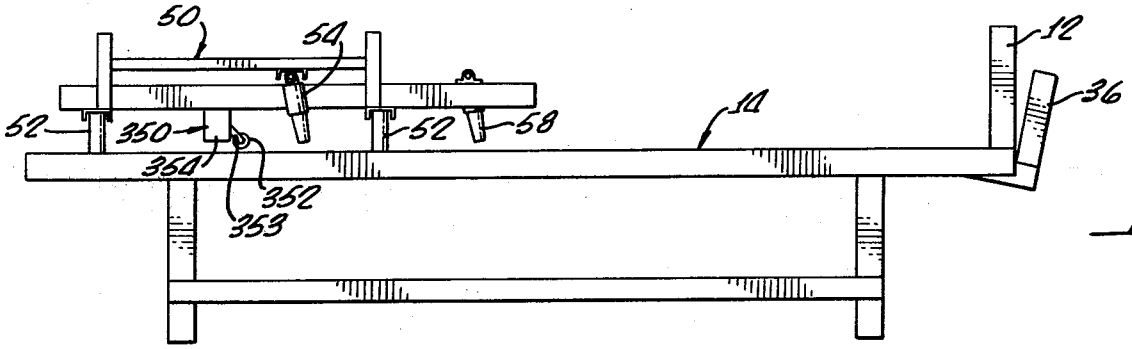
FIG. 16 shows a simplified side view of frame-making apparatus.

In a particular preferred embodiment, the flat plate 335 is raised and lowered automatically without the need for operator intervention in order to properly staple the forward and rear stiles to the headers. FIG. 16 illustrates an automatic switching means for accomplishing this. Therein is shown a side view of the assembly platform 14 and the overhead staple gun mount assembly 50, which is supported on pneumatic support elevators 52. Staple guns 54 and 58 are shown suspended from the overhead assembly. Also, shown adjacent the staple gun, is sensing roller assembly 350. The sensing roller assembly comprises a wheel 352 rotatably mounted on shaft 353 which is rotatably suspended from support element 354. When the sensing roller 352 rides upon a header, it activates a switching means (not shown) to cause pneumatic cylinder 338 (shown in FIG. 9) to move flat plate 335 downwardly so that surface 348 will engage the oncoming rear stile. However, when a forward stile is approaching staple guns 54 and 56, there is no header under sensing roller 352 and, thus, it does not activate pneumatic cylinder 338. Accordingly, the cylinder remains in contracted position with flat plate 335 lifted upwardly such that the approaching forward stile does not contact surface 348, but instead contacts surface 330. As previously explained, the delayed triggering action resulting from the longitudinal distance between surface 348 and surface 330 causes the staple guns to fire later, and, thus, to fire staples into the trailing edge of the forward stile.

FRAME THICKNESS ADJUSTMENTS

Figure 14:
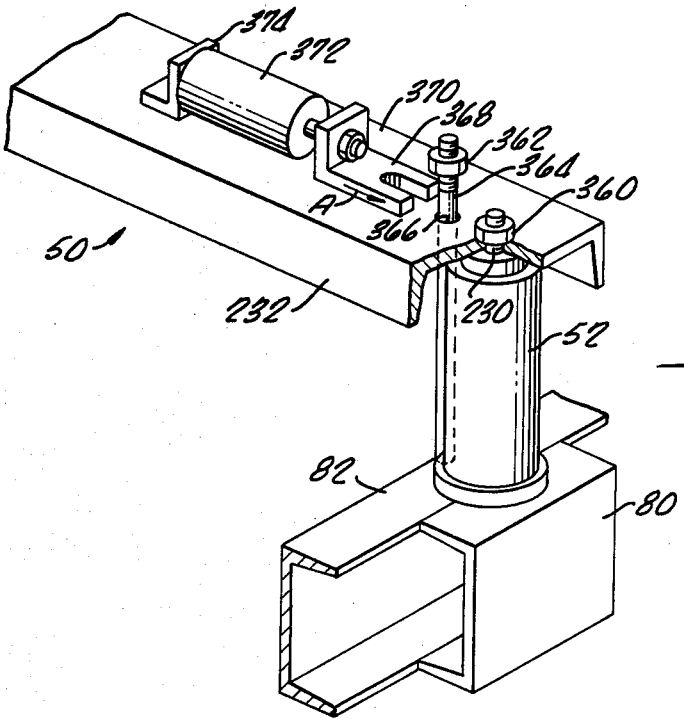
FIG. 14 shows an overhead gun carriage elevator assembly in partially cutaway perspective.
Figure 15:
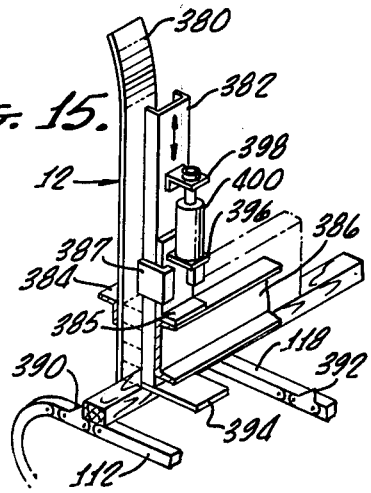
FIG. 15 shows one end of an adjustable hopper for feeding stiles of different thicknesses.

FIGS. 14 and 15 show the principle adjusting means used to adapt the apparatus of this invention for making door frames of different thicknesses. FIG. 14 shows one of the pneumatic support elevators 52 mounted with elevator mount 80 on elevator support beam 82, as previously discussed in connection with FIG. 2. The pneumatic support elevator 52 is securely fastened by fastening means 360 to the main cross beam 232 of the overhead gun mount assembly 50, as previously described in connection with FIG. 4.

When headers and stiles of different thickness are desired to be stapled, it is necessary to move the various staplers up or down according to the thickness of the boards used. This is achieved by activating pneumatic elevators 52 to lift or lower the overhead assembly 50. In the embodiment shown in FIG. 14, three thicknesses of boards can be used. Thus, with the elevator 52 fully contracted so that the overhead assembly 50 is at its lowest level, staplers can be used with the thinnest stiles and headers contemplated. When thick stiles and headers are desired to be use, elevator 52 is activated to lift main cross beam 232 of the overhead assembly 50 until the main cross beam hits stop 362 on guide rod 364 which extends through an opening 366 in main cross beam 232 and is attached to the assembly platform 14 below (by means not shown).

When boards of intermediate thickness are desired to be used, the forked plate spacer 368 is inserted between the upper surface 370 of main cross beam 232 and the stop 362 by moving spacer 368 outwardly as indicated by the arrow A using pneumatic cylinder 372, which is also mounted by mounting means 374 to the main cross beam 232. When the spacer 368 is in position, the lifting action of elevator 52 terminates when the spacer contacts stop 362 and, thus, the overhead assembly 50 does not lift the staple guns to as high a level as is possible when spacer 368 is retracted.

FIG. 15 illustrates the mechanism for adapting the stile hopper for use with stiles of different thicknesses. As shown in FIGS. 15 and 16, the stile hopper comprises rear guides 380 and forward guides 382. The rear guide 380 is mounted on angle beam 384 and the forward guide 382 is mounted on channel beam 386. Both beams 384 and 386 extend all the way across the assembly platform 14 and are mounted (as shown in fragmentary view in FIG. 2) on a mounting post 388.

As shown in FIG. 15, when the lug 390 on rear stile drive chain 112 or the lug 392 on forward stile drive chain 118 engages a stile and strips it from stile hopper 12, the succeeding stiles in the hopper drop down to be sequentially picked up by later engagement with similar lugs. It is important that the space between foot 394 of guide 382 and the surface of the chains 112 and 118 be greater than the thickness of the stile used, but not sufficiently great as to allow two stiles to be removed at the same time from the stile hopper 12. To adjust the apparatus for using stiles of different thicknesses, the forward guide 382 is slidably mounted, as by guide 387, on mount 385, which is attached to channel 386. The forward guide 382 is also equipped with a bracket 398 which connects it to tab 396 of mount 385 via pneumatic cylinder 400. Thus, to adjust the space between foot 394 and chains 112 and 118 to increase or decrease the clearance, an operator activates pneumatic cylinder 400 (by switching means not shown) to move forward guide 382 upwardly or dow-wardly. (A similar rear guide 380 and forward guide 382 is provided on the opposite side of stile hopper 12.)

FIG. 11 shows a completed door frame 402, prepared in accordance with the invention, having two lockblocks 404, two identical stiles 406 and two identical headers 408, all secured together with staples 410.

Other variations of the invention are contemplated. For example, two complete sets of guns can be installed on parallel axles and actuated to staple a third stile midway between the forward and rear stiles. This is desirable to make bi-fold doors, for example, by installing a wide middle stile and then cutting the frame in half longitudinally and hinging the halves together. Such extra guns may also be used as spares to avoid shutting down operations due to a single gun failure. Similar apparatus may also be adapted for use in making other types of frames than door frames, having analogous components.

Still other uses and variations of the invention will be apparent to those skilled in the art, and while various specific embodiments of this invention have been shown, these are intended for illustrative purposes only. It is intended that the scope of the invention be limited only by the attached claims.

What is claimed is:

1. A method for making a door frame including a lockblock comprising the steps of:

providing an elongated assembly platform having a rear end portion and a forward end portion;

positioning on said rear end portion of lockblock;

positioning a forward stile to the rear of said lockblock, said forward stile having end portions and a mid-portion;

positioning a rear stile to the rear of said forward stile;

positioning a pair of headers between said forward and rear stiles;

providing supporting means for said end portions of said forward stile and for said lockblock;

aligning said lockblock along the mid-portion of said forward stile in contact therewith and fastening said lockblock to said mid-portion;

conveying said forward stile with said lockblock fastened on the forward side thereof along said assembly platform;

terminating said supporting means of said lockblock while maintaining said supporting means for said end portions of the forward stile;

rotating said forward stile about its longitudinal axis until said lockblock is positioned to the rear thereof and in a common substantially horizontal plane therewith;

conveying said headers and rear stile forwardly to form a rectangle with said forward stile; and fastening said stiles and headers at the corners of said rectangle, thereby forming said door frame with the lockblock fastened inside along the midportion of the forward stile thereof.

2. A method as recited in claim 1 including the steps of:

providing fastening means for injecting a fastener into the corners of said rectangle to fasten said stiles to said headers;

moving said fastening means parallel to the direction of movement of said stiles and headers; and injecting a fastener from said fastening means while both the fastening means and the stiles and headers are moving relative to said assembly platform, the movement of said fastening means being synchronized to match that of the stiles and headers at the moment said fastener is injected.

3. A method as recited in claim 2 wherein said fastening means comprises a staple gun and said fastener comprises a staple, said staple gun being suspended pivotally about an axis which is positioned transverse to the direction of movement of said stiles and headers and parallel to the plane of said assembly platform.

4. A method as recited in claim 3 wherein said staple gun is activated to inject said staple by the movement of said stiles and headers on the assembly platform beneath said staple gun.

5. Apparatus for making a rectangular door frame from a forward stile, a rear stile, a pair of headers and at least one lockblock comprising:

(a) an assembly platform;

(b) support means adapted to support the ends of the stiles of said door frame on said assembly platform;

(c) conveying means adapted to convey said stiles longitudinally along said assembly platform;

(d) support means adapted to support the headers of said door frame perpendicular to said stiles and in the same horizontal plane therewith, said support means being adapted to permit said headers to be pushed along said assembly platform between said stiles;

(e) means for assembling said stiles and headers into a rectangle;

(f) means for positioning a lockblock on said assembly platform;

(g) means for supporting and conveying said lockblock along said assembly platform;

(h) means for fastening said lockblock to the front of said forward stile;

(i) means for rotating said forward stile after said lockblock is fastened thereto to position said lockblock inside said rectangle;

(j) means for injecting a fastener into the corners of said door frame to fasten the stiles and headers together;

(k) sensing means adapted to detect the position of said stiles and headers relative to said fastening means; and (l) triggering means responsive to said sensing means adapted to cause said fastening means to inject said fastener into said corners of the door frame.

* * * * *

UNITED STATES PATENT AND TRADEMARK OFFICE

CERTIFICATE OF CORRECTION

PATENT NO. : 4,175,313

DATED : Nov. 27, 1979

INVENTOR(S) : PAUL G. NEUMANN

It is certified that error appears in the above-identified patent and that said Letters Patent are hereby corrected as shown below:

Column 13, Claim 1, Line 5, change "of" to ---a---.

Signed and Sealed this

*First* Day of *April 1980*

[SEAL]

*Attest:*

SIDNEY A. DIAMOND

*Attesting Officer*

*Commissioner of Patents and Trademarks*